United States Patent [19]

Schlage

[11] 3,971,356

[45] July 27, 1976

[54] SOLENOID-DASHPOT

[75] Inventor: Robert E. Schlage, St. Charles, Mo.

[73] Assignee: ACF Industries, Incorporated, New York, N.Y.

[22] Filed: Sept. 9, 1975

[21] Appl. No.: 611,823

[52] U.S. Cl. ..... 123/198 D; 123/DIG. 11; 123/97 R; 251/55

[51] Int. Cl.[2] ..... F02B 77/00

[58] Field of Search... 123/198 D, 198 DB, 198 DC, 123/179 B, 179 BG, 179 G, 97 R, 97 B, 103 R, 103 E, DIG. 11; 251/48, 55 X, 130

[56] References Cited

UNITED STATES PATENTS

| | | | |
|---|---|---|---|
| 2,088,174 | 7/1937 | Paullin | 251/48 X |
| 2,636,516 | 4/1953 | Armstrong et al. | 251/130 X |
| 3,035,774 | 5/1962 | Ray | 251/130 X |
| 3,407,845 | 10/1968 | Coohsley | 251/130 X |
| 3,730,153 | 5/1973 | Harrison et al. | 123/DIG. 11 X |
| 3,741,332 | 6/1973 | Sakakibaia et al. | 123/198 D X |
| 3,760,785 | 9/1973 | Harrison et al. | 123/DIG. 11 X |
| 3,805,760 | 4/1974 | Yagi et al. | 123/DIG. 11 X |
| 3,847,131 | 11/1974 | Hisatomi | 123/97 R X |

*Primary Examiner*—Charles J. Myhre
*Assistant Examiner*—Ira S. Lazarus

[57] ABSTRACT

A unitary device for controlling the rate of throttle closure and for preventing after run of an internal combustion engine is provided with simplified structure, the structure using a single shaft assembly for both functional operations. The shaft assembly is operatively connected to a diaphragm assembly which moves in response to forces acting to position the shaft assembly. The shaft assembly is an axially aligned and concentrically arranged combination, and includes a first shaft element which acts against the diaphragm assembly to bring a carburetor for an internal combustion engine slowly to its curb idle setting upon throttle release from some running condition. A second shaft element of the shaft assembly is controlled by a solenoid. The second shaft element acts against the diaphragm assembly upon ignition system de-energization, and permits the closure of the throttle below the curb idle setting of the carburetor. Quick release means are provided in the diaphragm assembly for venting any air compressed by diaphragm movement toward the off position of the device.

19 Claims, 4 Drawing Figures

SOLENOID-DASHPOT

BACKGROUND OF THE INVENTION

This invention relates to carburetor control devices, and in particular is intended to be used in conjunction with a carburetor for an internal combustion engine to provide the dual functions of controlling throttle closure rate after removal of an operator input command so that the carburetor throttle slowly returns to a curb idle setting, and for permitting the throttle to close to a setting below its curb idle setting upon de-energization of the ignition system for the internal combustion engine.

The prior art reveals a number of devices which function to slow throttle movement during the transition from a run condition to a curb idle condition of an internal combustion engine. These devices are known in the art, and are defined for the purposes of this specification, as a "dash pot". In general, a dash pot is a diaphragm valve device which includes a shaft extending outwardly from a diaphragm valve housing. The diaphragm valve is arranged so that it is capable of reciprocal movement between first and second positions. In a first direction of movement, the action of the diaphragm valve offers increased resistance to shaft movement, so that the shaft moves between the first and second positions slowly. In internal combustion engines, this action is applied to the throttle of the carburetor so that removal of an operator input command, for example, by removing pressure on the accelerator pedal of a conventional passenger vehicle, causes some linkage for controlling throttle movement to bear against the dash pot shaft. The diaphragm valve of the dash pot offers resistance to shaft movement so that the throttle returns to its curb idle position at a controlled rate. A controlled return to the curb idle is important in meeting emission standards for exhaust gases of the internal combustion engine. A spring commonly is provided on one side of the diaphragm which is compressed at the curb idle position. The spring returns the diaphragm and its associated shaft to its initial position upon a command for increased acceleration. The shaft then is able to re-engage the throttle or throttle linkage upon removal of the succeeding operator command.

The prior art also reveals solenoid actuated devices which set the curb idle position-of-the carburetor. In general, these devices include a solenoid energized by the vehicle ignition system so that a second shaft is positioned to engage a suitable throttle linkage at the curb idle position of the carburetor. Upon de-energization of the solenoid, the second shaft retracts so that the throttle is permitted to move to a position below the curb idle setting. Internal combustion engines finding application in present-day passenger vehicles, for example, tend to operate at higher curb idle speeds than older models of those vehicles. When the ignition system is de-energized at the high r.p.m. curb idle speeds, the internal combustion engine has a tendency to continue to draw air and fuel through the carburetor so that the engine exhibits what is known in the art and for the purposes of this specification as after run, in that the engine continues to operate in a manner similar to a diesel engine. Use of solenoid operated devices to permit throttle closure below the curb idle position prevents the occurrence of the after run condition.

While these prior art devices work well for their intended purposes, as a class they have been characterized by relatively expensive constructions. In addition, the use of separate devices has required the use of valuable space in the engine compartment, when space is at a premium as vehicle manufacturers continually attempt to reduce automobile size.

The invention described hereinafter provides the dual function of controlled throttle release and after run prevention by providing a single unit for accomplishing these functions. The device itself is simpler in construction and lower in cost than designs now used for that purpose.

One of the objects of this invention is to provide a simplified structure for providing controlled throttle release and preventing engine after run.

Another object of this invention is to provide an integrally constructed unit providing the dual functions of throttle control and after run prevention.

Yet another object of this invention is to provide a dual function device utilizing a single shaft assembly for dual function operation.

Still another object of this invention is to provide a diaphragm assembly having internal valve means for enhancing diaphragm movement between a first position and a second position.

Yet another object of this invention is to provide a unitary device for providing controlled throttle release and preventing engine after run which permits easy adjustment of the curb idle position of an internal combustion engine.

Other objects of this invention will be apparent to those skilled in the art in light of the following description and accompanying drawings.

SUMMARY OF THE INVENTION

In accordance with this invention, generally stated, a carburetor control unit is provided which controls the rate of throttle closure and prevents after run of internal combustion engines. The control unit includes a single shaft assembly having first and second concentrically arranged movable shafts. The shafts are operatively connected to a diaphragm assembly. The first shaft contacts a throttle means of a carburetor and is designed, through the action of the diaphragm assembly, to bring the carburetor throttle slowly to its curb idle position, after removal of an operator input command. The second shaft is a solenoid controlled member also contacting the throttle means at the curb idle position of the carburetor. The solenoid is electrically connected to the engine electrical system. Upon electrical system de-energization, the second shaft moves from the curb idle position, permitting the throttle to close below the curb idle setting. Means are provided in the diaphragm assembly for venting any air compressed by diaphragm movement as the diaphragm moves from the curb idle to off position.

DESCRIPTION OF THE PREFERRED EMBODIMENT

Figure 1:
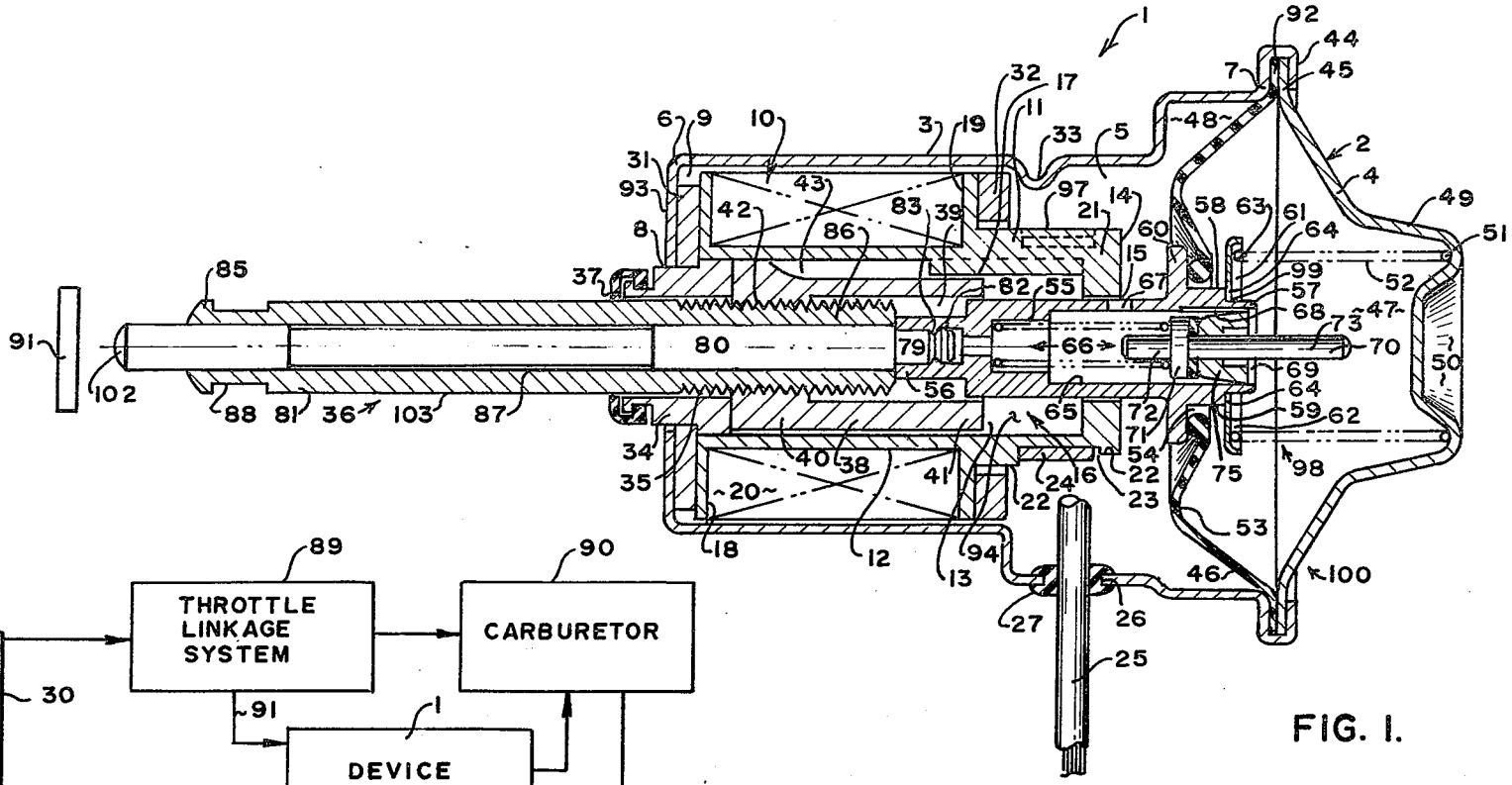
FIG. 1 is a cross sectional view of control unit of this invention.

Referring now to FIG. 1, reference numeral 1 indicates the device of this invention. The device 1 includes a housing 2 which has a first section 3 and a second section 4 joined to one another so as to delimit a chamber 5.

The section 3 generally is cylindrical in plan, having a first end 6 and a second end 7. The section 3 is open along the end 7, while the end 6 is closed by a wall 93. The wall 93 has a central opening 8 through it, which communicates with the chamber 5. The section 3 defines a solenoid container 9 along the end 6 side of the section. The container 9 houses a conventional solenoid 10. The solenoid 10 includes a spool 11 which preferably is constructed from non-magnetic material. Molded plastic works well, for example. The spool 11 is formed in part by a central core 12 having an axial opening 13 through it. The core 12 is open bottomed along its first end, and has a top wall 14 closing a second end 21 of it. The top wall 14 has a central opening 15 through it. With the solenoid 10 positioned as shown in the drawings, the openings 15, 13 and 8 are aligned axially to define a passage 16.

The opening 13 through the core 12 has a rib 17 extending outwardly from and integrally formed with an interior side wall 94 delimiting the opening 13, the rib 17 being positioned near the end 21 of the core 12. The purpose of the rib 17 is described in greater detail hereinafter.

The core 12 also has a pair of flanges 18 and 19, respectively, extending outwardly from it. The flanges 18 and 19 have an electrical winding 20 disposed between them in a conventional manner. The core 12 includes a side wall 97 near the end 21 of the core 12. The side wall 97 has a plurality of protrusions 22 formed and extending outwardly from it, which define an annular channel 23. The channel 23 is sized to receive an electrical conductor 24 in a relatively loose, friction fit. The conductor 24 is electrically connected to a lead wire 25 which enters the chamber 5 through an opening 26 in the section 3 of the housing 2. The opening 26 may, and preferably does, have a suitable protective grommet 27 mounted in it, for maintaining a desired environmental condition within the chamber 5. Conductor 24 also is electrically connected to the winding 20 of the solenoid 10 in a conventional manner.

Figure 2:
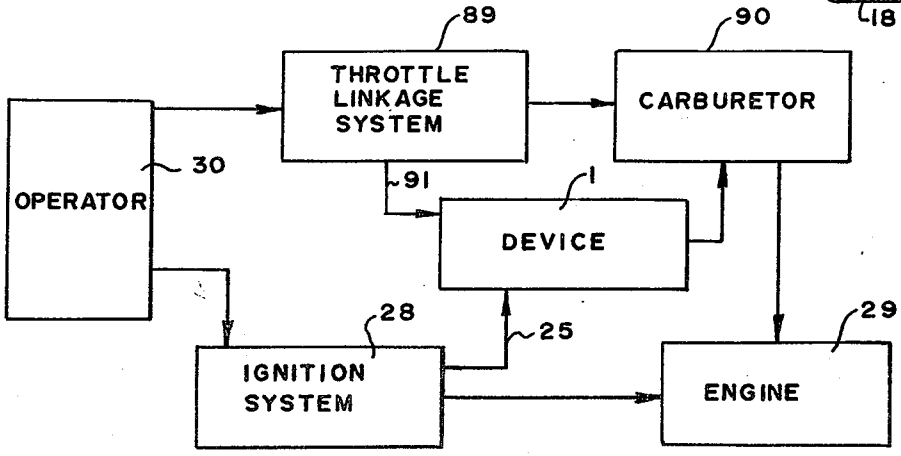
FIG. 2 is a block diagrammatic representation illustrating the use of the control unit of FIG. 1 in an internal combustion engine.

The lead 25 is electrically connected to an ignition system 28 of a vehicle utilizing an internal combustion engine 29 as its drive source, these last-mentioned components being diagrammatically illustrated in FIG. 2. Energization of the ignition system 28 by an operator 30 energizes the winding 20 of the solenoid 10.

One of a pair of spacers 31 and 32 abut respective ones of the flanges 18 and 19, the spacers being used to position the solenoid 10 properly within the container 9. Any convenient design may be used for the spacers 31 and 32. Common disc type washer shapes are acceptable, for example. The section 3 may be deformed, as indicated at 33, to maintain solenoid 10 position. Other position maintaining expedients are compatible with the broader aspects of this invention.

An end piece 34 is mounted in the opening 8 and projects both inwardly of the opening 13 in the core 12, and outwardly of the wall 93. The end piece 34 has a central opening 35 through it which serves as a guide for a shaft assembly 36, described in greater detail hereinafter. That part of the end piece 34 extending outwardly of the wall 93 may be formed to facilitate the reception of a suitable dust cover 37, the dust cover 37 being utilized to maintain the environmental quality of the chamber 5.

An armature 38 is movably mounted within the opening 13 of the core 12. Armature 38 generally is cylindrical in plan, having a central opening 39 extending through it. The armature 38 has a first end 40 and a second end 41, and the opening 39 has a reduced diameter for a predetermined distance, near the end 40, along an internally threaded wall 42. The armature 38 also has a groove 43 formed in it, which is designed to receive the rib 17 in a loose, slip fit as the armature 38 moves in response to energization and de-energization of the winding 20. The interconnection of the rib 17 and groove 43 prevents rotation of the armature 38, which is important in operation of the device 1, as described in greater detail hereinafter.

The open end 7 of the section 3 has an annular lip 44 formed in it, while the section 4 has a peripheral flange 45 formed about it. The flange 45 and lip 44 are interconnected with one another to complete the housing 2. It is a conventional diaphragm valve construction technique to attach a peripheral edge 92 of a flexible diaphragm 46 along the flange 45-lip 44 interconnection so as to divide the chamber 5 into a first chamber part 47 and a second chamber part 48.

The section 4 of the housing 2 is conventional and generally has a frusto-conical shape between the flange 45 and an integral end cap structure 49. The end cap 49 has an annular receptacle 50 formed in it, which serves to seat an end 51 of a diaphragm spring 52. As indicated, the section 4 is interconnected with the section 3 to form a diaphragm valve assembly and solenoid actuated combination with the single housing 2 of the device 1.

The diaphragm 46 is a principle element of a diaphragm assembly 100. The diaphragm 46 may comprise any one of a plurality of suitable materials, the particular design illustrated being constructed from a molded, flexible material. An expansion rib 53 is formed in the diaphragm 46 during its manufacture in order to ensure sufficient diaphragm flexibility for the relatively long distance of travel required in the operation of the device 1. Other diaphragm designs are compatible with the broader aspects of our invention. The diaphragm 46 has a central opening 54 in it, which receives a hub 55 in a conventional manner.

Hub 55 is an elongated structure having a first end 56 and a second end 57. The end 57 has an outer wall 58 which defines both a notch 59 and a flange 60. The notch 59 is designed to receive and support a keeper 61 held against the notch 59 by the force exerted through the spring 52.

Keeper 61 is a disc-like structure having a central opening 99 in it, for receiving the hub 55. The keeper 61 abuts the notch 59 on a first side, and has an upturned rim 62 extending outwardly of the plane of the disc on a second side of the disc. The rim 62 enables the keeper 61 to seat an end 63 of the spring 52. Keeper 61 also has a plurality of openings 64 positioned about and extending radially from the central hub receiving opening 99. The openings 64 preferably communicate with the opening 99, but communication is a matter of design choice. The function of the openings 64 is described in detail hereinafter. It is sufficient to here note that the diaphragm 46 is positioned between the flange 60 and the keeper 61 so that there is some degree of play between the diaphragm 46 and either of the flange 60 or keeper 61.

The hub 55 also includes an internal wall 65 which defines an axial opening 66, the opening 66 extending through the hub 55. As is observable in the drawings, the opening 66 has a plurality of varying diametric sections. The hub 55 also has an opening 67 extending radially outwardly from the axial opening 66, through the outer and internal walls 58 and 65, respectively, so that a communicative path exists between the opening 65 and the chamber part 48 side of the diaphragm 46. The internal wall 65 has an axial groove 68 formed in it, along the end 57 of the hub 55. Groove 68 is important in the operation of the device 1, as described hereinafter.

The end 57 of the hub 55 is closed by a valve seat 69 of a valve assembly 98. The valve seat 69 is an annular member having a central opening in it, the central opening permitting passage of a valve stem 70. The seat 69 may be integrally formed with the hub 55, or it may be manufactured separately and attached to the hub 55 by any convenient method. Seat 69 has at least one opening in it, which is closed by a valve means 75 in the energized condition of the solenoid 10.

The valve stem 70 preferably is constructed from plastic material or the like, and has a flange 71 extending radially outwardly from it. The flange 71 divides the stem 70 into a first part 72 and a second part 73. A spacer 74 and the valve means 75 are inserted over the stem 70 on the part 73 side of the stem. The spacer 74 is conventional, and may comprise any of a variety of disc-shaped devices, for example, which act to ensure the proper seating of the valve means 75. Valve means 75 preferably has a body 101 having a U-shape in cross section. Body 101 has a face 76 which abuts the valve seat 69 in the closed position of the valve means 75, thereby blocking passage of air through the valve assembly 98.

The part 72 side of the flange 71 receives a first end of a spring 77. A second end of the spring 77 seats against a reduced diameter portion 78 defined by the wall 65. It thus may be observed that the spring 77 acts against the flange 71, which transmits the applied force to the valve means 75, thereby driving the face 76 against the valve seat 69.

Shaft assembly 36 includes a first shaft 80 and a second, concentrically arranged shaft 81. The shaft 80 is an elongated, cylindrical structure having a first end 79 and a second end 102. The end 79 of the shaft 80 is attached to the end 56 of the hub 55 by any convenient method. In the embodiment illustrated, for example, the end 79 of the shaft 80 has a head 82 formed in it, outboard of a notch 83 in the shaft. A protrusion 84 extends inwardly of the opening 66 near the end 56 of the hub 55. The end 79 of the shaft 80 is inserted into the opening 66 from the end 56 side of the hub 55 until the protrusion 84 engages the notch 83, mounting the hub 55 and shaft 80 to one another. Other interconnection techniques are compatible with the broader aspects of this invention.

The shaft 81 includes a generally cylindrical outer wall 103, the shaft having an end 85 and an end 86. The shaft 81 has an axial opening 87 extending through it, which is designed to pass the shaft 80 in a loose, free fit. The wall 103 defines a wrench notch 88 near the end 85 of the shaft 81, the wall 103 also defining a plurality of threads along the end 86 of the shaft for engagement with the threads of the armature 38. Consequently, a shaft assembly is provided having a pair of coaxially arranged shafts 80 and 81 which are capable of movement independently of one another. The shaft 80 is attached physically to the hub 55, while the dimensions of the device 1 and components thereof are arranged so that the end 86 of the shaft 81 abuts the end 56 of the hub 55 in at least one operating position of the device 1.

The general operation of this invention can be understood best with reference to FIG. 2. As there shown, the operator 30 starts the internal combustion engine 29 through the action of the ignition system 28. The ignition system 28, for the purposes of this specification, is intended to encompass the entire electrical circuit configuration required for engine 29 operation. As previously described, the ignition system 28 provides an electrical input to the device 1 along the conductor 25. The operator 30 controls engine 29 speed through a throttle linkage system 89 which controls air flow through a carburetor 90. The throttle system 89 includes an arm 91 or other suitable structure for engaging the shaft assembly 36 of the device 1. The device 1 controls certain changes imposed on the carburetor 90 by the operator 30, those functions being the described controlled rate of return to curb idle condition, the curb idle setting itself, and the closure of the carburetor throttle below the curb idle setting upon deactivation of the ignition system 28.

FIG. 1 illustrates a running condition for the engine 29. That is, FIG. 1 shows the position of the device 1 for engine 29 operating conditions other than at curb idle or the off position of the engine. As shown in FIG. 1, the arm 91 of the throttle linkage system 89 is spaced from the end 102 and end 85 of the shafts 80 and 81, respectively. Initial activation of the ignition system, by the operator 30, energizes the winding 20 so that the armature 38 is drawn to the position shown in FIG. 1. In addition, the spring 52 drives the diaphragm assembly 100 to the position illustrated so that the end 102 of the shaft 80 extends beyond the end 85 of the shaft 81.

The linkage system 89 is designed so that the arm 91 strikes the end 102 of the shaft 80 upon removal of the throttle command by the operator 30. The arm 91 forces the shaft 80, and, consequently, the diaphragm assembly 100, against the opposite force provided by the spring 52. The force exerted by arm 91 will drive the diaphragm assembly 100 to the position shown in FIG. 3. The time required for the shaft 80 to travel between the positions shown in FIGS. 1 and 2 is controlled by the action of the diaphragm assembly 100. As the shaft 80 moves to the position shown in FIG. 3, where the ends 102 and 85 of the respective shafts 80 and 81 are approximately co-planer, it attempts to drive the diaphragm 46 against both the bias of the spring 52 and the air pressure on the chamber part 47 side of the diaphragm. The combined air pressure and the spring 52 force slows the rate of the shaft 80 movement to some predetermined controlled rate. The groove 68 in the hub 55 allows some air leakage to occur between the chamber parts 47 and 48 sides of the diaphragm. That slow controlled leakage aids in the continuous, controlled retreat of the shaft 80 to the position shown in FIG. 3.

Figure 3:
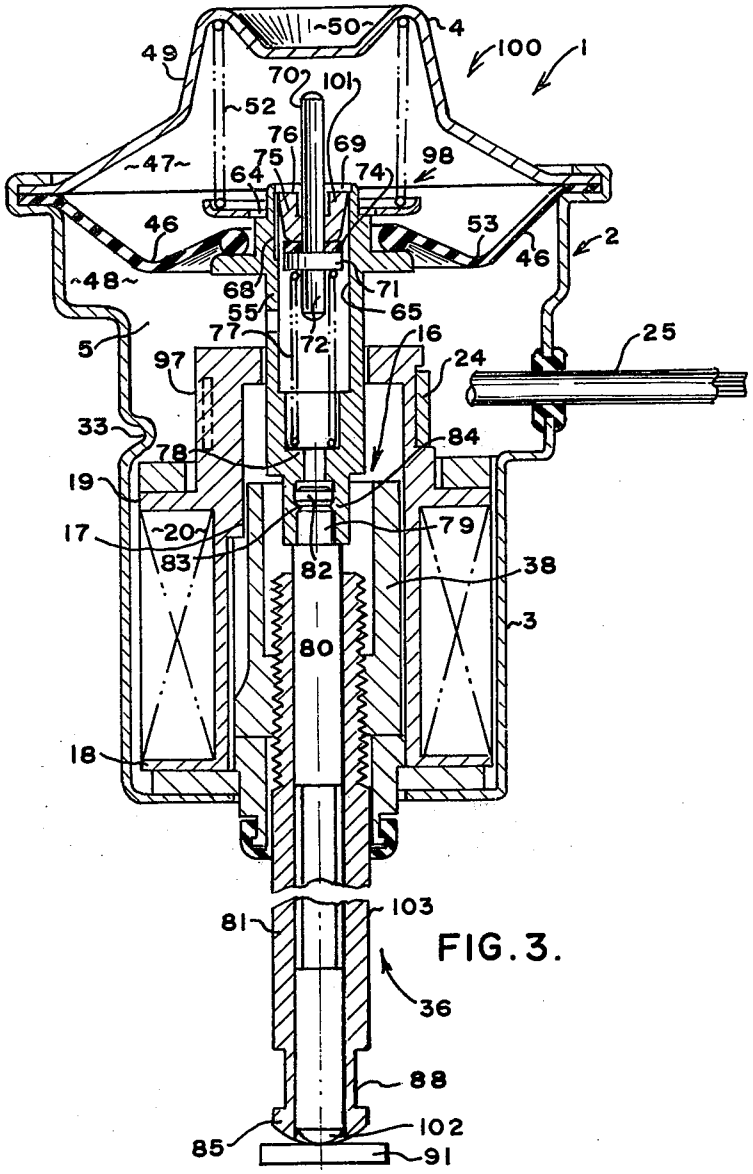
FIG. 3 is a sectional view, partly broken away, of the control unit shown in FIG. 1, illustrated in a curb idle position.

FIG. 3 illustrates the curb idle condition of the carburetor 90. The curb idle setting is controlled by the position of the shaft 81. As indicated, activation of the solenoid 10 draws the armature 38 to the position shown in FIGS. 1 and 3. The force acting on the armature 38 so as to draw it toward the end 6 of the housing 2 is greater than the force of the arm 91 of the linkage system 89 acting against it. Consequently, the position of the end 85 after solenoid 10 energization delimits the curb idle setting for the carburetor 90. The curb idle setting of the carburetor 90 may be adjusted by rotating the shaft 81 along the threaded portion of the armature 38 and shaft 81. Rotation is facilitated by the wrench notch 88 formed near the end 85 of the shaft 81. The intermeshing of the rib 17 of the core 12 and the groove 43 in the armature 38 prevents armature 38 rotation and allows the easy adjustment of curb idle position.

Figure 4:
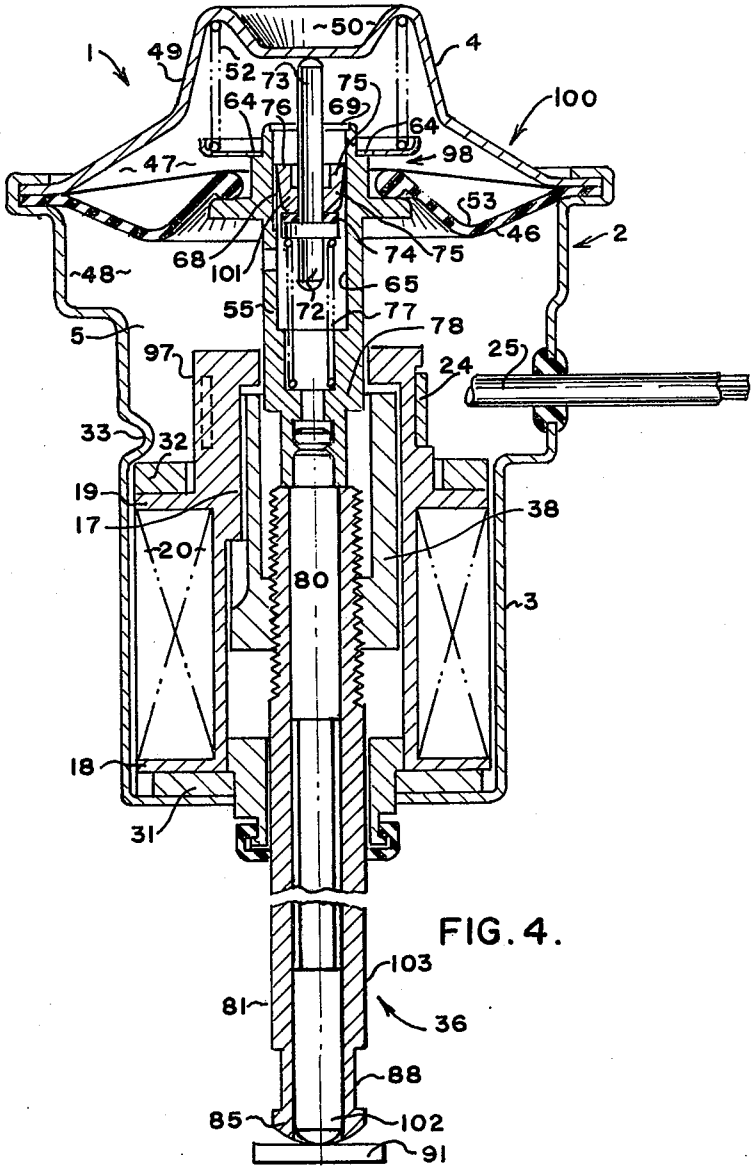
FIG. 4 is a cross sectional view, partly broken away, of the control unit of FIG. 1, illustrated in an engine off position.

Deactivation of the ignition system 28 de-energizes the solenoid 10, and the armature 38 moves to the position shown in FIG. 4. As the armature 38 moves to its FIG. 4 position, the shaft 81 engages the hub 55, driving the diaphragm assembly 100 to the FIG. 4 position. Movement of the diaphragm assembly between the position shown in FIGS. 3 and 4 must occur in a relatively rapid manner if after run of the engine 29 is to be prevented. The normal operation of the diaphragm assembly 100 mitigates against such rapid movement, the purpose of the diaphragm assembly being the controlled movement described in conjunction with the shaft 80 movement. Valve assembly 98 operates to permit the rapid movement of the diaphragm assembly 100 between the positions shown in FIGS. 3 and 4. Movement of the diaphragm assembly because of the force of the arm 91 acting against the shaft assembly 36 causes the valve stem 70 to strike the end cap 49, unseating the valve means 75 from the valve seat 69. Air pressure on the chamber part 47 side of the diaphragm 46 will be released quickly to the chamber part 48 side of the diaphragm through the opening in the valve seat 69 and the opening 67 in the hub 55. Consequently, the shaft 81 is permitted to move quickly between the position shown in FIG. 3 to that shown in FIG. 4, and the throttle of the carburetor 90 closes to a position below the curb idle setting after ignition de-energization.

Reactivation of the ignition system 28 causes windings 20 to draw the armature 38 to the position shown in FIG. 3. Movement to the FIG. 3 position is aided by the force exerted by the spring 52. During repositioning of the device 1 to the curb idle position following winding 20 energization, there may be a tendency for air in the chamber part 48 side of the diaphragm 46 to be compressed during diaphragm assembly 100 movement. Compression of air in the chamber part 48 would slow the movement of the diaphragm assembly. Air compression is eliminated in the device 1 through the use of the openings 64 in the keeper 61. The openings 64 permit air flow from the chamber part 48 to the chamber part 47 side of the diaphragm 46, should the diaphragm unseat itself from the flange 60.

Further throttle linkage system 89 activation, so as to draw the arm 91 away from its abuttment with the end 85 of shaft 81, enables the spring 52 to drive the shaft 80 back to the position shown in FIG. 1. In addition, the disengagement of the valve stem 70 and end cap 49, which occurs upon ignition system 28 activation, enables the spring 66 to drive the valve means 75 against the valve seat 69. The device 1 is then ready to operate in the manner described.

It thus may be observed that a unitary device is provided which accomplishes rate of throttle closure control and prevents after run of an internal combustion engine, and which meets all the ends and objects herein set forth above.

Numerous variations, within the scope of the appended claims, will be apparent to those skilled in the art in light of the foregoing description and accompanying drawings. Thus, the design silhouette of the housing 7 may vary in other embodiments of our invention. While certain materials were described as preferred in constructing components of the device 1, various other materials are compatible with the broader aspects of the invention. Designs of individual structural components of the device 1 may vary. The form of the valve assembly 98 may vary. For example, the valve means 75 may be a spring bias conical section which opens upon engagement with the end cap 49. These variations are merely illustrative.

Having thus described the invention, what is claimed and desired to be secured by Letters Patent is:

1. An integral solenoid and dash pot device for regulating the carburetor of an internal combustion engine comprising:

a housing, said housing defining a solenoid container and a diaphragm chamber;

a solenoid mounted in said solenoid container, said solenoid including a core having an axial opening through it, and an armature mounted for movement in the axial opening of said core, said armature having a longitudinal opening through it;

a diaphragm assembly including a flexible diaphragm movable between at least a first position and a second position, said diaphragm having a central opening in it, said diaphragm adapted to divide said diaphragm chamber into a first chamber part and a second chamber part; a hub mounted to said diaphragm along said central opening, said hub having a first end and a second end; a valve assembly mounted in the first end of said hub, said valve assembly arranged to permit communication between said first chamber part and said second chamber part upon a predetermined distance of travel of said diaphragm in a first direction, and to close communication between said first and said second chamber parts after a predetermined distance of travel of said diaphragm in a second direction; and a shaft assembly movably mounted in said housing, said shaft assembly including a first shaft and a second shaft coaxially arranged with respect to one another, said second shaft being attached to said hub and said first shaft being adjustably connected to the armature of said solenoid.

2. The device of claim 1 wherein said hub has a groove formed in it, said groove permitting controlled leakage between said first and said second chamber parts as said diaphragm moves in one direction of travel between said first and said second positions.

3. The device of claim 2 wherein said core has a rib projecting inwardly of the axial opening through said core, and said armature is further characterized by a groove formed in said armature, said groove being adapted to receive said rib, the interconnection of said rib and said groove preventing rotation of said armature.

4. The device of claim 3 wherein said diaphragm assembly is further characterized by a keeper plate mounted to said hub, and a diaphragm spring biased between said housing and said keeper plate, said keeper plate having at least one air release opening formed in it, said air release opening permitting communication between said first and said second chamber parts as said diaphragm moves between said first and said second positions in a second direction of travel.

5. A device for emission control and for preventing after run of an internal combustion engine, said engine having a carburetor, an arm operatively connected to a throttle linkage system, and an ignition system, comprising:

a housing defining a solenoid container and a diaphragm chamber;

a solenoid assembly mounted in said container, said solenoid assembly including a winding electrically connected to said ignition system, and an armature mounted for movement between a first position and a second position, said armature having a longitudinal opening through it;

a diaphragm assembly including a flexible diaphragm having a peripheral edge engaged along the interconnection of said solenoid container and said diaphragm chamber parts of said housing, said diaphragm being movable between a first position and a second position, and a hub mounted to said diaphragm, said hub having a first end and a second end; and a shaft assembly movably mounted to said device, said shaft assembly including a first shaft and a second shaft coaxially arranged with respect to one another, said second shaft being mounted to said hub and said first shaft being adjustably mounted to said armature.

6. The device of claim 5 further characterized by a valve assembly mounted in the first end of said hub, said valve assembly arranged to permit communication between said first chamber part and said second chamber part upon a predetermined distance of travel of said diaphragm in a first direction, and to close communication between said first and said second chamber parts after a predetermined distance of travel of said diaphragm in a second direction.

7. The device of claim 6 wherein said hub has a groove formed in it, said groove permitting controlled leakage between said first and said second chamber parts as said diaphragm moves in a first direction of travel between said first and said second positions.

8. The device of claim 7 wherein said solenoid includes a core having said windings disposed on it, said core having an axial opening through it, said armature being movably mounted in the axial opening of said core, said core further including a rib projecting inwardly of said axial opening, said armature having a groove in it for receiving said rib, the interconnection of said rib and said groove preventing rotation of said armature.

9. The device of claim 8 wherein said diaphragm assembly is further characterized by a keeper plate mounted to said hub, and a diaphragm spring biased between said housing and said keeper plate, said keeper plate having at least one air release opening formed in it for permitting the passage of air between said first and said second chamber parts as said diaphragm moves in a second direction between said first and second positions.

10. The device of claim 9 wherein said armature includes an interior threaded wall and the first shaft of said shaft assembly includes an outer wall having a threaded portion interconnectable with the threaded wall of said armature, the interconnection of the first shaft of said shaft assembly with said armature being adjustable to set the curb idle position for said internal combustion engine.

11. An internal combustion engine having a control device, said engine having a carburetor, linkage system means operatively connected to said carburetor and to said device, an ignition system electrically connected to said engine, diaphragm actuated means for controlling the time required to return to a curb idle setting from a run position of said carburetor, and a solenoid actuated device for controlling the curb idle position of said carburetor and for permitting said carburetor to close below the curb idle setting upon deactivation of said ignition system, the improvement which comprises a single shaft assembly operatively connected between said diaphragm actuated means, said solenoid actuated device, and said carburetor, said shaft assembly comprising a first shaft having an axial opening through it, said first shaft having an outer wall, and means for connecting said first shaft to said solenoid actuated device; and a second shaft, said second shaft being movably mounted in the axial opening of said first shaft, said second shaft having a first, free end and a second end attached to said diaphragm actuated means.

12. The improvement of claim 11 wherein said diaphragm actuated means, said solenoid controlled device, and said shaft assembly are operatively arranged in a single enclosure.

13. The improvement of claim 12 wherein said diaphragm actuated means includes a diaphragm assembly comprising a flexible diaphragm movable between at least a first position and a second position, said diaphragm having a central opening in it, a hub mounted to said diaphragm along said central opening, said hub having a first end and a second end, and a valve assembly mounted to the first end of said hub, said valve assembly adapted to close communication between opposite sides of said diaphragm and arranged to permit communication between opposite sides of said diaphragm after a predetermined distance of travel of said diaphragm in a first direction of travel, and to reclose such communication after a predetermied distance of travel in a second direction.

14. The improvement of claim 13 wherein said hub has a groove formed in it, said groove permitting controlled leakage between first and second sides of said diaphragm as said diaphragm moves in said first direction of travel.

15. The improvement of claim 14 wherein said diaphragm actuated means is further characterized by a keeper plate mounted to said hub, and a diaphragm spring biased against said keeper plate, said keeper plate having at least one air release opening formed in it for permitting equalization of air pressure on opposite sides of said diaphragm as said diaphragm moves in said second direction of travel between said first and said second positions.

16. The improvement of claim 15 wherein said solenoid actuated device includes a solenoid assembly comprising a core having an axial opening through it, said core having an electrical winding disposed about it, and an armature, said armature being movably mounted in the axial opening of said core.

17. The improvement of claim 16 wherein said armature has a longitudinal opening in it, said opening having a threaded portion, the outer wall of said first shaft having a complementary threaded portion formed in it for attaching said first shaft to said armature.

18. The improvement of claim 17 wherein said core assembly has a rib projecting radially inwardly of the axial opening in the core of said solenoid assembly, and said armature has a groove adapted to receive said rib, the interconnection of said rib and said groove preventing rotational movement of said armature.

19. An internal combustion engine having a control device, said engine having a carburetor, linkage means operatively connected to said device, and an ignition system electrically connected to said engine, which comprises:

a solenoid assembly mounted near said carburetor, said solenoid assembly including a winding electrically connected to said ignition system, a core, said core having said winding disposed about it and further having an axial opening through it, and an armature movably responsive to energization and de-energization of said winding, said armature being mounted in the axial opening of said core;

diaphragm actuated means aligned with said solenoid assembly along an axis defined by said axial opening through said core, said diaphragm actuated means comprising a flexible diaphragm movably mounted between a first position and a second position in response to forces acting on opposed sides of said diaphragm, said diaphragm having a central opening in it, and a hub mounted to said diaphragm along said central opening; and a shaft assembly having a first shaft and a second shaft, said first and said second shafts being coaxially disposed and independently movable with respect to one another, said first shaft being operatively connected to the armature of said solenoid assembly and said second shaft being attached to said hub.

* * * * *